US010954675B1

(12) United States Patent
Markway

(10) Patent No.: US 10,954,675 B1
(45) Date of Patent: Mar. 23, 2021

(54) ICE BREAKER FOR AN ARCHITECTURAL METAL ROOF

(71) Applicant: John B. Markway, Tebbetts, MO (US)

(72) Inventor: John B. Markway, Tebbetts, MO (US)

( * ) Notice: Subject to any disclaimer, the term of this patent is extended or adjusted under 35 U.S.C. 154(b) by 129 days.

(21) Appl. No.: 16/168,201

(22) Filed: Oct. 23, 2018

Related U.S. Application Data

(60) Provisional application No. 62/707,137, filed on Oct. 23, 2017.

(51) Int. Cl.
*E04D 13/10* (2006.01)
*E04D 3/30* (2006.01)

(52) U.S. Cl.
CPC ..... *E04D 13/10* (2013.01); *E04D 3/30* (2013.01)

(58) Field of Classification Search
CPC ..... E04D 13/10; E04D 3/30; E04D 13/0481; E04H 12/22
See application file for complete search history.

(56) References Cited

U.S. PATENT DOCUMENTS 507,776 A 10/1893 Berger
511,295 A * 12/1893 Esselen ..... E04D 13/10 52/24
625,144 A * 5/1899 Clark ..... E04D 13/10 52/24
654,438 A * 7/1900 Clark ..... E04D 13/10 52/24
853,897 A * 5/1907 Porter ..... E04D 13/0481 52/24
1,085,474 A * 1/1914 Peterson ..... E04D 13/10 52/15
1,222,953 A * 4/1917 Histand ..... E04D 13/10 52/24
1,475,931 A 12/1923 Campbell
1,530,233 A * 3/1925 Campbell ..... E04D 13/10 52/24
2,129,833 A 9/1938 Fradette
2,201,320 A * 5/1940 Place ..... E04D 13/10 52/25
2,851,935 A * 9/1958 Weeks ..... E01F 9/571 404/13
3,296,750 A * 1/1967 Zaleski ..... E04D 13/10 52/24
3,568,381 A * 3/1971 Hale ..... E04B 7/102 52/81.4
D221,941 S * 9/1971 Murphy ..... E04D 13/10 D25/199
4,359,842 A * 11/1982 Hooker ..... A63H 33/16 52/18
4,548,004 A * 10/1985 Chastain ..... E04B 1/3211 52/81.1

(Continued)

FOREIGN PATENT DOCUMENTS

JP 08246709 A * 9/1996

*Primary Examiner* — Brian D Mattei
*Assistant Examiner* — Charissa Ahmad
(74) *Attorney, Agent, or Firm* — Grace J. Fishel

(57) ABSTRACT

An ice breaker for installation on an architectural roof on a flat between the seams of a metal panel. The ice breaker has a pointed upslope end and an irregular polygon base with non-equilateral triangular faces extending from the irregular polygonal base that meet at a truncated top. The non-equilateral triangular faces at the upslope end being symmetrical about a centerline axis.

7 Claims, 6 Drawing Sheets

(56) References Cited

U.S. PATENT DOCUMENTS 4,719,726 A * 1/1988 Bergman ..... E04B 1/3211 52/81.4
4,763,450 A 8/1988 Daniel
5,002,424 A * 3/1991 Hedgewick ..... E01F 9/553 359/531
5,044,130 A 9/1991 Chiddister
5,205,088 A * 4/1993 Mueller ..... E04D 3/40 52/24
5,343,659 A 9/1994 Zaleski
D360,476 S * 7/1995 Smeja ..... D25/199
5,470,170 A * 11/1995 Lindner ..... E01F 9/553 404/13
5,471,799 A * 12/1995 Smeja ..... E04D 13/10 52/24
5,570,557 A * 11/1996 Kwiatkowski ..... E04D 3/30 248/237
5,664,374 A * 9/1997 Lee ..... E04D 13/10 52/24
5,706,609 A 1/1998 Heino
5,890,324 A * 4/1999 Maanum ..... E04D 13/103 248/237
5,901,507 A 5/1999 Smeja et al.
5,943,826 A 8/1999 Totin
5,966,883 A * 10/1999 Krusec ..... E04D 13/00 52/302.1
6,266,929 B1 * 7/2001 Cline ..... E04D 13/10 52/24
6,415,570 B1 * 7/2002 Wentz ..... E04D 13/0481 52/302.1
D482,604 S * 11/2003 Smeja ..... A63H 33/16 D8/499
D499,011 S * 11/2004 Rizzo ..... E01F 9/553 D8/499
D505,065 S * 5/2005 Smeja ..... E01F 9/553 D8/499
D529,377 S * 10/2006 Heiss ..... D9/431
D601,414 S * 10/2009 Riley ..... G09B 23/02 D8/499
D616,728 S * 6/2010 Bucci ..... D8/354
D631,729 S * 2/2011 Bucci ..... E04B 1/3211 D8/354
7,997,032 B2 8/2011 Riley et al.
8,763,311 B2 7/2014 Lupski
9,630,571 B1 * 4/2017 Newsome ..... B60R 99/00
2003/0182870 A1 * 10/2003 Smeja ..... E04D 13/10 52/24
2005/0014112 A1 * 1/2005 Fentress ..... G09B 23/02 434/211
2007/0271855 A1 * 11/2007 Stearns ..... E04D 13/10 52/24
2010/0192479 A1 8/2010 Elliott et al.

* cited by examiner

ICE BREAKER FOR AN ARCHITECTURAL METAL ROOF

BACKGROUND OF THE INVENTION

Field of the Invention

The present invention relates to an ice breaker for attachment to metal panels of an architectural roof just above the eaves.

Brief Description of the Prior Art

Metal roofing is becoming more and more popular as composition shingles rise in price. In addition to cost, metal roofing also benefits from being light weight, strong, fire resistant and energy efficient. On the other hand, the formation of sheets of ice on metal roofs is a problem. Snow is melted by the sun and from heat coming through the roof from the building below which then freezes into sheets of ice which are channeled in the panels between the seams of the metal roof. In the next cycle of heating, the ice begins to melt and a layer of water forms between the top surface of the roof and the ice. As the ice continues to melt, it will tend to hydroplane on the layer of water and slide off the roof sometimes in large sheets. The falling sheets of ice may damage landscaping on the ground below or may fall dangerously onto pedestrians or vehicles. In addition, the falling sheets of ice may cause significant damage to the rain gutter below the roof. This problem has been addressed by hanging the gutter lower below the roof but then water may shoot over the gutter defeating the purpose of a rain gutter.

Snow blocks are commonly used to keep accumulated snow from sliding from a roof. While effective at retaining snow on the roof as shown in FIG. 15, they increase the load on the roof which can cause the roof to cave when the snow load is excessive. In addition, snow blocks do not address the unique problems of ice sheets forming in the channels of metal roofs.

BRIEF SUMMARY OF THE INVENTION

In view of the above, it is an object of the present invention to provide an ice breaker for use on a metal roof. It is another object to provide an ice breaker that may be installed close to the eaves out-of-sight and from the ground. Other objects and features of the invention will be in part apparent and in part pointed out hereinafter.

In accordance with the invention, an ice breaker for use on a metal roof is disclosed that may be easily installed in a flat area between the seams of a metal roof preferably such that it stands slightly proud of the seams. The ice breaker is a three-dimensional figure formed from a thermoplastic material. The ice breaker has an irregular polygonal base with an upslope end and a downslope end. The figure has non-equilateral triangular faces extending from the irregular polygon base that meet at a truncated top parallel to the base through which a screw may be driven for attachment of the ice breaker to the metal panel.

In one form, the irregular polygonal base is pentagonal and the truncated top is rhomboidal. For other embodiments, the triangular faces are flat plates but in some embodiments the triangular faces are dished. Other particular aspects may include a pointed downslope end with the downslope faces rising at 30 degrees from the base.

Still further aspects include a support tube under the truncated top through which the screw passes for attachment of the ice breaker to the metal roof. In a preferred embodiment support tube may be recessed from the base forming a pocket into which caulk may be injected for providing a water resistant seal between the ice breaker, screw and the metal roof.

Other aspects of the invention are described below, the particular features mentioned above not being limiting.

The invention summarized above comprises the constructions hereinafter described, the scope of the invention being indicated by the subjoined claims.

BRIEF DESCRIPTION OF THE SEVERAL VIEWS OF THE DRAWINGS

In the accompanying drawings, in which several of various possible embodiments of the invention are illustrated, corresponding reference characters refer to corresponding parts throughout the several views of the drawings in which.

DETAILED DESCRIPTION OF AT LEAST ONE PREFERRED EMBODIMENT OF THE INVENTION

Figure 1:
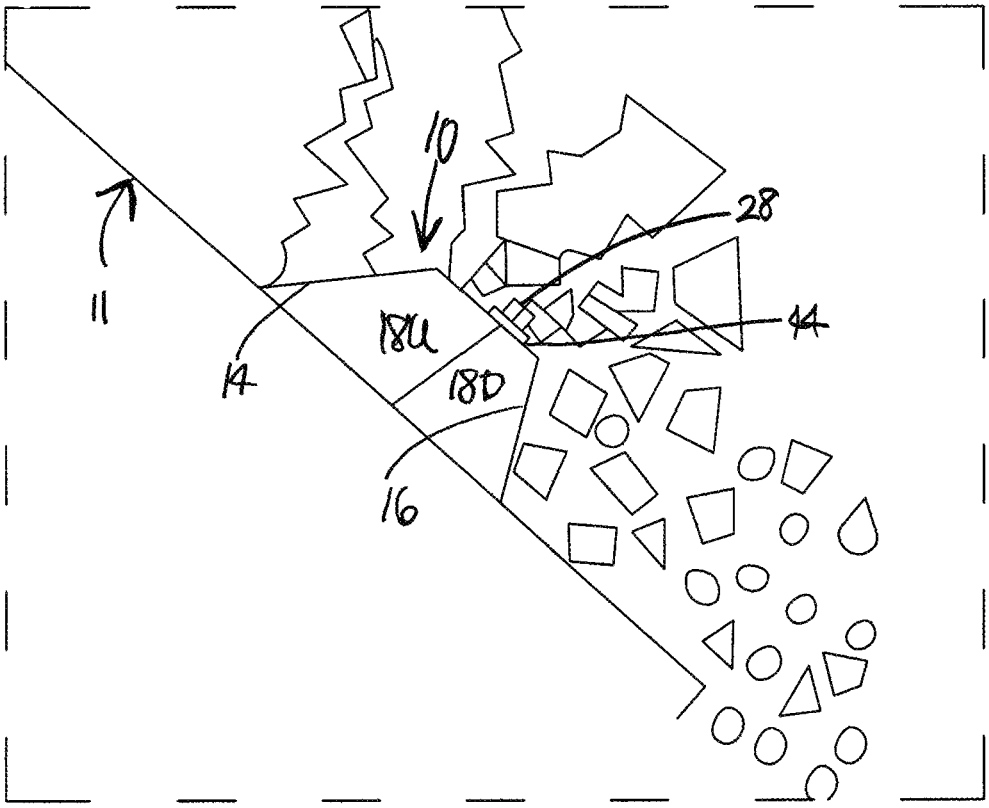
FIG. 1 is side elevation showing a first ice breaker in accordance with the present invention installed on an architectural roof having metal panels.
Figure 2:
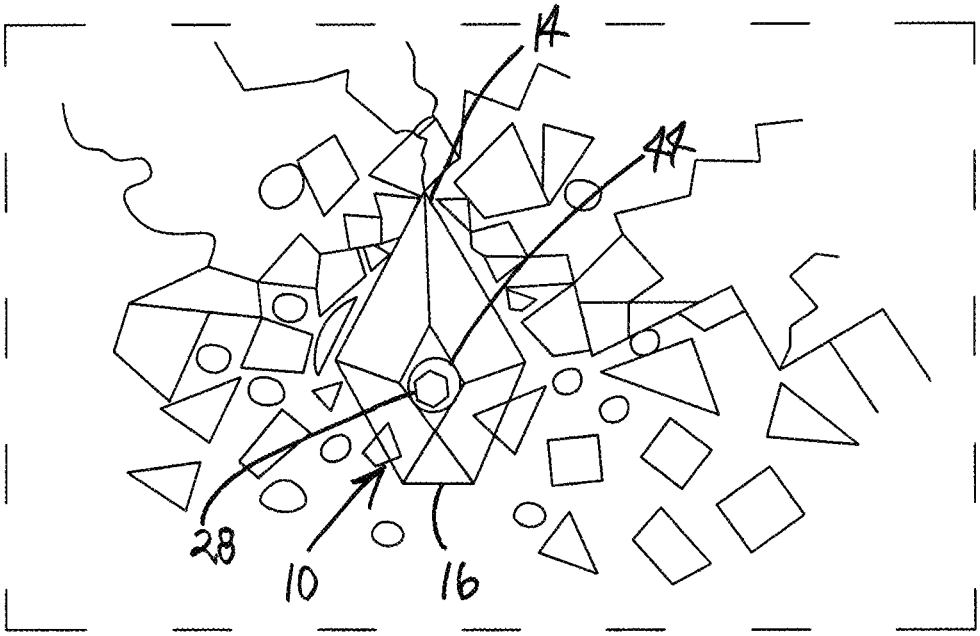
FIG. 2 is a top view of the ice breaker shown in FIG. 1.
Figure 3:
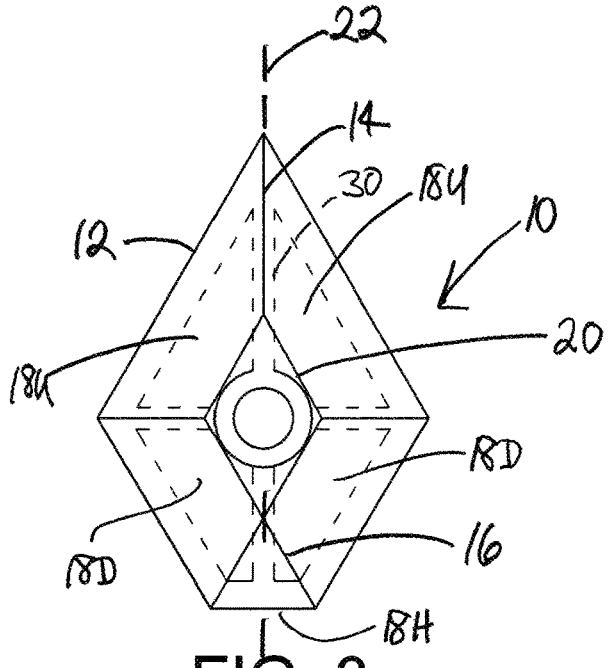
FIG. 3 is plan view of the ice breaker.
Figure 8:
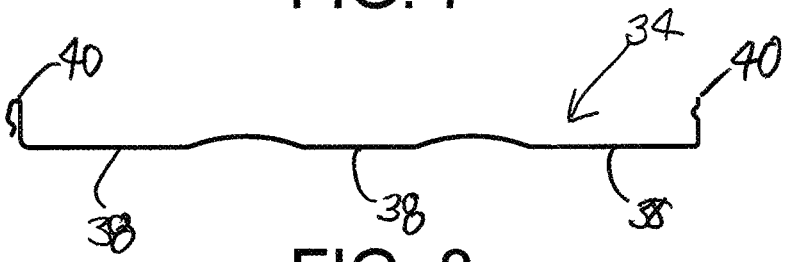
FIG. 8 is a schematic view of a representative standing seam metal roof panel.
Figure 9:
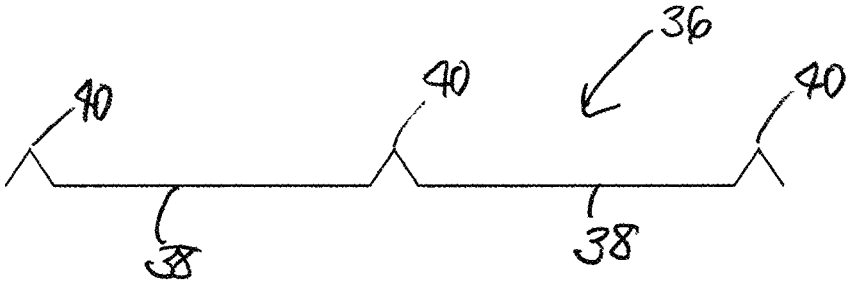
FIG. 9 is a schematic view of a representative agriculture metal roof panel.
Figure 13:
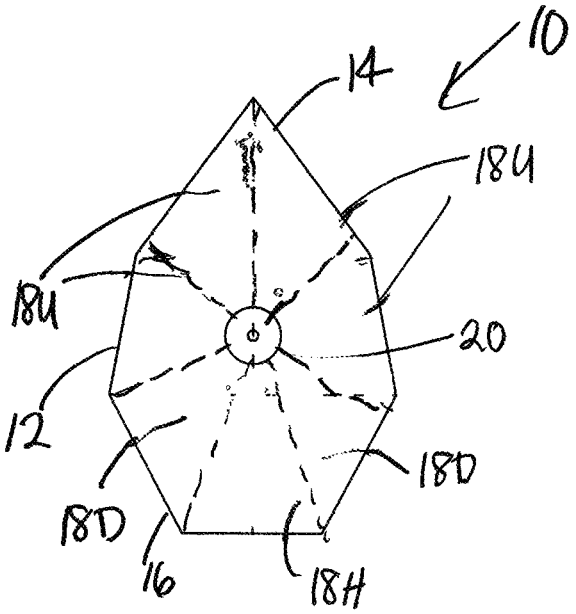
FIG. 13 is a top view of a third ice breaker in accordance with the present invention.
Figure 14:
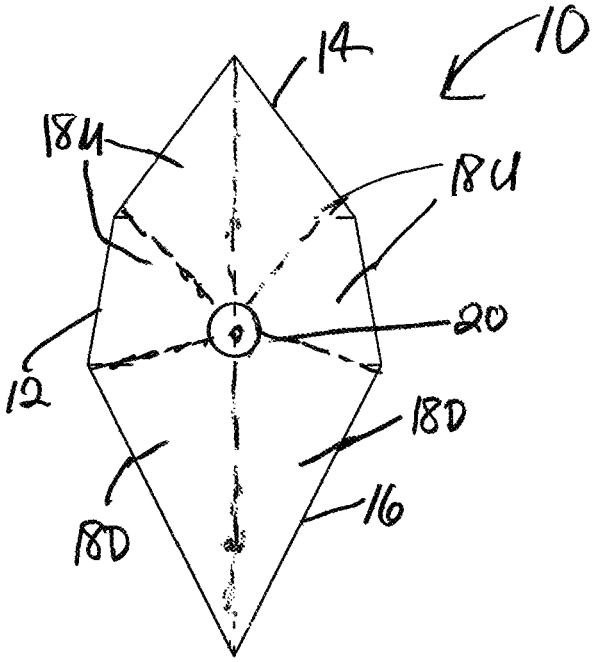
FIG. 14 is a top view of a fourth ice breaker in accordance with the present invention; and, FIG. 15 is a perspective view of ice blocks installed on a metal roof in accordance with the prior art.
Figure 15:
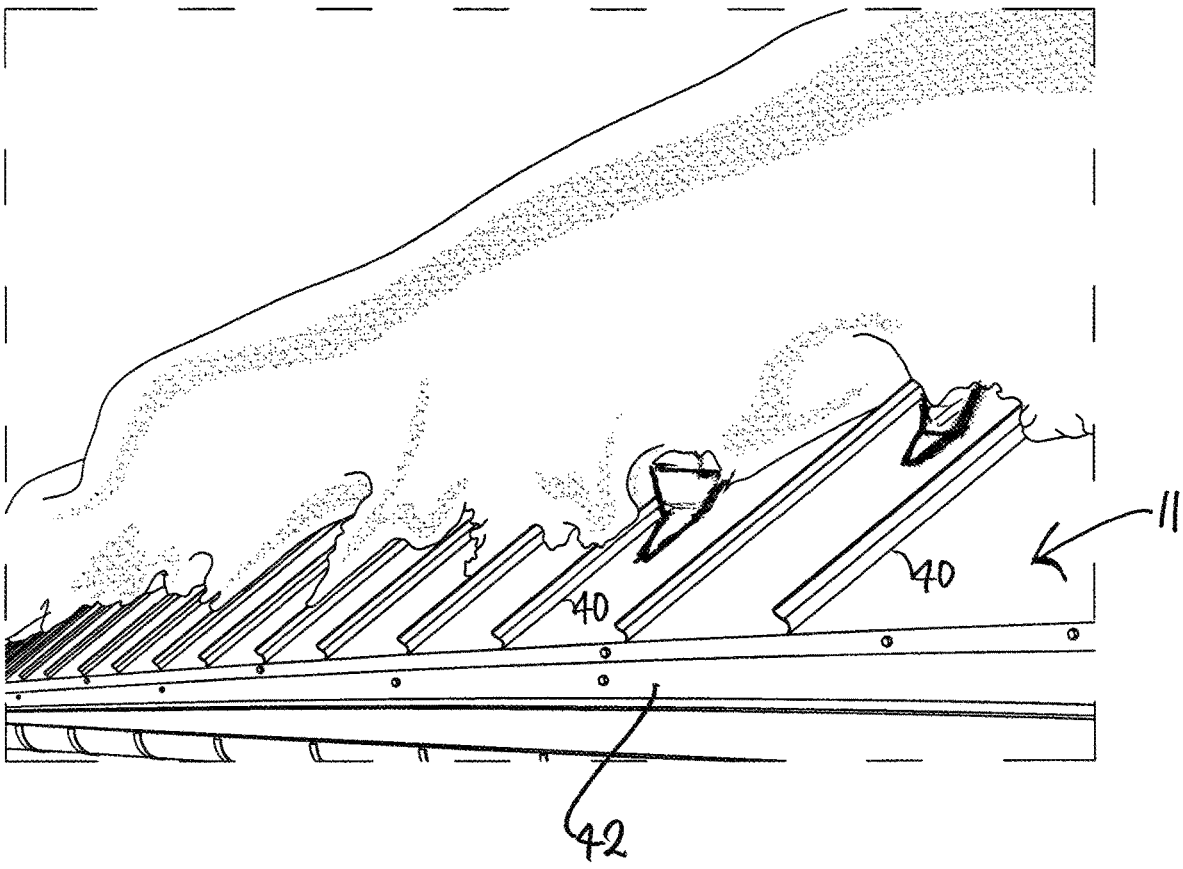
Prior Art FIG. 15

Referring to the drawings more particularly by reference character, FIGS. 1 and 2 show an ice breaker 10 in accordance with the present invention on a pitched, architectural roof with a slope, with metal panels as shown in FIGS. 8, 9 and 15 which are more particularly described below. Ice breaker 10 is a three dimensional figure having an irregular polygonal base 12 with at least five sides as shown in FIGS. 3-7. Ice breaker 10 may be a six-member irregular polygon as shown in FIG. 14, seven member irregular polygon as shown in FIG. 13 or the like.

Ice breaker 10 has a first upslope pointed end 14 and a second downslope supporting end 16. The three dimensional figure has non-equilateral triangular faces 18 that meet at a phantom vertex to form a pyramidal shape with a truncated top 20 parallel to base 12. In the form illustrated in FIGS. 3-7, truncated top 20 is polygonal, more particularly rhomboidal. With continuing reference to FIGS. 3-7, triangular faces 18U are non-equilateral and preferably symmetrical about a centerline axis 22 (FIG. 3) for better ice load distribution. The shape of downslope triangular faces 18D is less critical as the function of downslope end 16 is to buttress upslope end 14 against the forces imposed by downwardly sliding ice.

Figure 10:
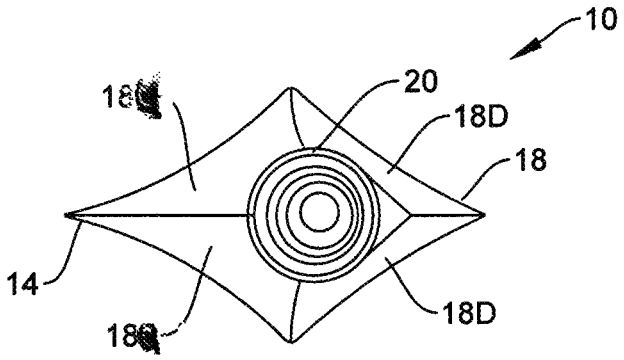
FIG. 10 is a top view of a second ice breaker in accordance with the invention.
Figure 11:
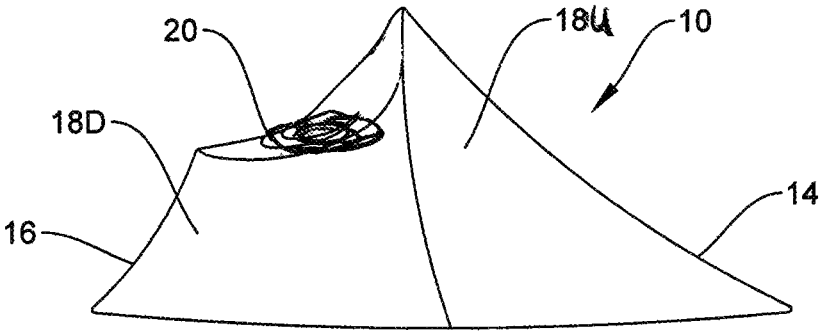
FIG. 11 is a side elevation of the second ice breaker.
Figure 12:
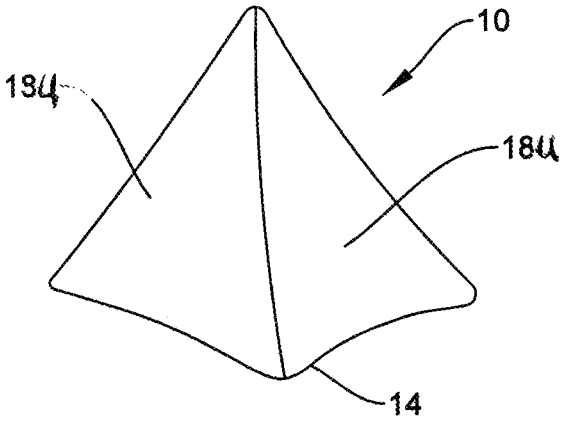
FIG. 12 is an front elevation at the upslope end of the second ice breaker.

As shown in FIGS. 3-7, non-equilateral triangular faces 18 (18U, 18D and 18H) are flat plates but in other embodiments as shown in FIGS. 10-12, non-equilateral triangular faces 18 may be dished and truncated top 20 may be circular.

Figure 4:
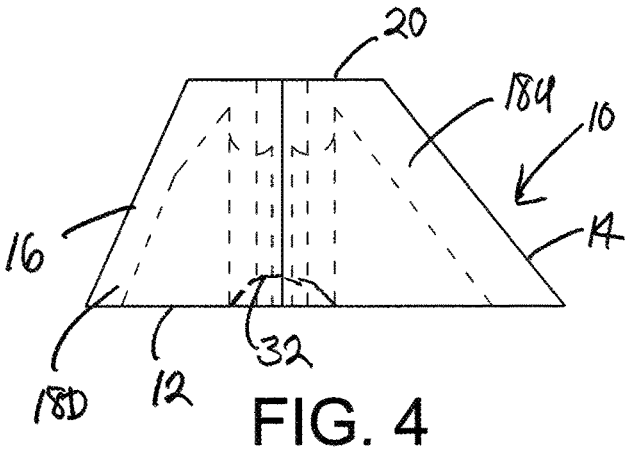
FIG. 4 is side elevation of the ice breaker.
Figure 5:
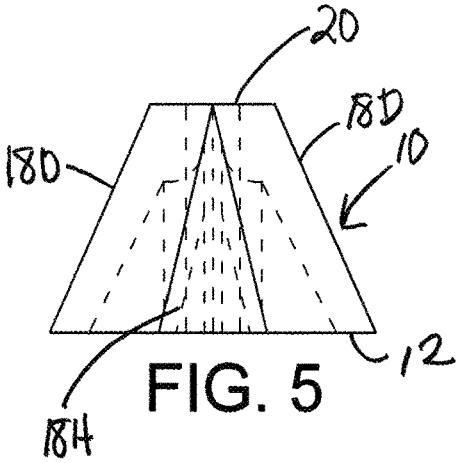
FIG. 5 is an downslope end view of the ice breaker.
Figure 6:
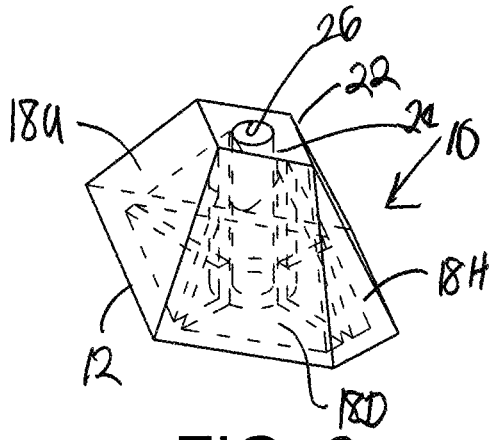
FIG. 6 is an top perspective view of the ice breaker viewed from the downslope end.
Figure 7:
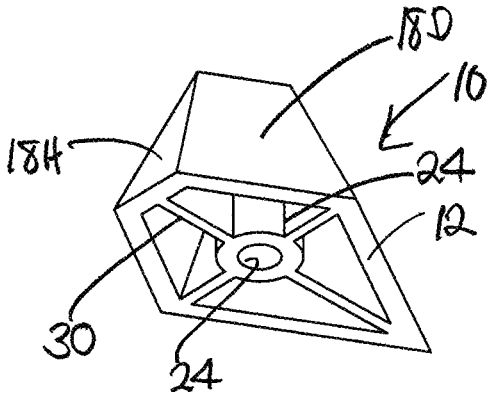
FIG. 7 is a bottom perspective view of the ice breaker viewed from the downslope end.

Ice breaker 10 is a hollow figure with a support tube 24, illustrated as cylindrical, under truncated top 20 reaching to the plane of base 12 with a through hole 24 aligned with a through hole 26 in truncated top 20 for a roofing screw 28 or other fastener for attaching ice breaker 10 to a metal panel. Tube 24 may be braced inside ice breaker 10 with vertical ribs 30 and recessed forming a pocket 32 as shown in FIG. 4 for sealing caulk as described below. This is an important feature as the pocket of caulk forms a seal about the puncture that screw 28 makes when it pierces the roof surface.

Ice breaker 10 may be suitably molded as a unitary item from thermoplastic material and may be colored to match the metal panels. For superior strength in use, ice breaker 10 may be made of nylon stranded plastic with a sun resistant inhibitor such as carbon black.

In use, ice breaker 10 may be used on standing seam metal roof panels 34 as shown in FIG. 8 or on less expensive agricultural metal roof panels 36 as shown in FIG. 9, both of which have a flat area 38 between seams or simulated seams 40. Preferably ice breaker 10 is attached with roofing screw 28 to the panels 34, 36 in flat area 38 out-of-sight about 18 inches above eaves 42. In most instances, this installation may be advantageously made from the ground without climbing on the roof.

Before screw 28, is threaded into ice breaker 10 caulk may be injected through the holes 24, 26 into the hollow interior of the figure filling pocket 32 under recessed tube 24 for a water resistant seal around screw 28 where it penetrates the metal panel. A nylon washer 44 or the like may be placed on top of truncated top 20, functioning as a water-resistant gasket, before screw 28 is threaded though truncated top 20, tube 24 and into the metal panel. Alternatively, ice breaker 10 may be attached with a peal and stick adhesive.

In a representative but non-limiting form, ice breaker 10 has a length of 2⅛" along centerline axis 22 and a width of 1½". It preferably has a height with washer 44 and screw 28 of 1¼" such that it extends proud above seams 40 which typically have a height of ¾". As aforementioned, upslope faces 28U have a rise of 30 degrees and downslope tapered faces 18D have a rise of 20 degrees and downslope heel face 18H has a rise of 20 degrees. Screw holes 24, 26 are 7/32" and screw 28 is a 2" roofing screw.

As illustrated in FIGS. 1 and 2, as ice slides into ice breaker 10 positioned on flat 38 proud above seams 40, the ice is split by upslope pointed end 14 and lifted as it slides along triangular faces 18U. This action causes the sheet to be broken into pieces of reduced size which may fall from the eaves without damaging the rain gutters, landscaping or forming a danger to pedestrians or vehicles.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. An ice breaker for a metal roof comprising a three-dimensional figure having an irregular polygonal base with a first upslope end and a second downslope end, said figure having non-equilateral generally trapezoidal faces extending from the irregular polygonal base that meet at a truncated top parallel to the base, said non-equilateral trapezoidal faces at the upslope end being symmetrical about a centerline axis, a support tube under the truncated top reaching to the base with a through hole aligned with a through hole in the truncated top and a plurality of ribs between the support tube and an interior of the trapezoidal faces and reaching to the base, said support tube recessed at the base forming a pocket for caulk.

2. An ice breaker for a metal roof comprising a hollow figure having an irregular pentagonal base with a first upslope end and a second downslope end, said figure having non-equilateral generally trapezoidal faces that meet at a truncated rhomboidal top parallel to the base, said non-equilateral trapezoidal faces at the upslope end being symmetrical about a centerline axis, a support tube under the truncated rhomboidal top reaching to the base with a through hole aligned with a through hole in the truncated rhomboidal top and a plurality of ribs between the support tube and an interior of the trapezoidal faces and reaching to the base, said support tube recessed at the base forming a pocket for caulk.

3. The breaker of claim 2 wherein the trapezoidal faces at the upslope end meet at an angle that rises at 30 degrees with respect to the base forming an ice breaker point.

4. The breaker of claim 2 wherein the ribs are vertical and the support tube is cylindrical.

5. An architectural roof with eaves and metal roof panels having a flat between seams with ice breakers attached to the flat of the metal roof panels within reaching distance of the panel from the eaves, said ice breakers comprising a three-dimensional figure having an irregular polygonal base with a first upslope end and a second downslope end, said figure having non-equilateral generally trapezoidal faces that meet at a truncated top parallel to the base, said non-equilateral trapezoidal faces at the upslope end being symmetrical about a centerline axis, a support tube under the truncated top reaching to the base with a through hole aligned with a through hole in the truncated top and a plurality of ribs between the support tube and an interior of the trapezoidal faces and reaching to the base, said support tube recessed at the base forming a pocket for caulk.

6. The architectural roof of claim 5 wherein the metal roof panels are standing seam metal roof panels.

7. The architectural roof of claim 5 wherein the metal roof panels are agricultural metal roof panels.

* * * * *